US007771908B2

(12) United States Patent
Wu et al.

(10) Patent No.: US 7,771,908 B2
(45) Date of Patent: Aug. 10, 2010

(54) ANTICURL BACKSIDE COATING (ACBC) PHOTOCONDUCTORS

(75) Inventors: Jin Wu, Webster, NY (US); Lanhui Zhang, Webster, NY (US); Lin Ma, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 435 days.

(21) Appl. No.: 12/033,247

(22) Filed: Feb. 19, 2008

(65) Prior Publication Data

US 2009/0208859 A1 Aug. 20, 2009

(51) Int. Cl.
*G03G 15/00* (2006.01)

(52) U.S. Cl. ..... 430/58.35; 430/58.75; 430/930

(58) Field of Classification Search ..... 430/58.35, 430/58.75, 930

See application file for complete search history.

(56) References Cited

U.S. PATENT DOCUMENTS

| | | | | |
|---|---|---|---|---|
| 4,265,990 | A | 5/1981 | Stolka et al. | |
| 4,298,697 | A | 11/1981 | Baczek et al. | |
| 4,338,390 | A | 7/1982 | Lu | |
| 4,560,635 | A | 12/1985 | Hoffend et al. | |
| 4,654,284 | A | 3/1987 | Yu et al. | |
| 5,021,309 | A | 6/1991 | Yu | |
| 5,069,993 | A | 12/1991 | Robinette et al. | |
| 5,096,795 | A | 3/1992 | Yu | |
| 5,919,590 | A | 7/1999 | Yu et al. | |
| 5,935,748 | A | 8/1999 | Yu et al. | |
| 6,303,254 | B1 | 10/2001 | Yu et al. | |
| 6,372,396 | B1 * | 4/2002 | Yu et al. | 430/56 |
| 6,528,226 | B1 | 3/2003 | Yu et al. | |
| 6,562,531 | B2 | 5/2003 | Niimi | |
| 6,939,652 | B2 | 9/2005 | Yu | |
| 2003/0158367 | A1 * | 8/2003 | Weinert et al. | 528/50 |
| 2004/0242804 | A1 * | 12/2004 | Medsker et al. | 525/407 |
| 2007/0166634 | A1 | 7/2007 | Qi et al. | |
| 2008/0004203 | A1 * | 1/2008 | Scheuing et al. | 510/475 |

OTHER PUBLICATIONS

Jin Wu et al., U.S. Appl. No. (not yet assigned) on Overcoat Containing Fluorinated Poly(Oxetane) Photoconductors, filed concurrently herewith, filed Feb. 29, 2008.

Jin Wu et al., U.S. Appl. No. (not yet assigned) on Overcoated Photoconductors, filed concurrently herewith, filed Feb. 29, 2008.

Jin Wu et al., U.S. Appl. No. (not yet assigned) on Backing Layer Containing Photoconductor, filed concurrently herewith, filed Feb. 29, 2008.

Mohamed I. Abu-Abed et al., U.S. Appl. No. 11/768,318 on Imaging Member, filed Jun. 26, 2007.

Jin Wu et al., U.S. Appl. No. 11/729,622 on Anticurl Backside Coating (ACBC) Photoconductors, filed Mar. 29, 2007.

Jin Wu et al., U.S. Appl. No. 11/728,006 on Photoconductors Containing Fluorinated Components, filed Mar. 23, 2007.

Jin Wu et al., U.S. Appl. No. 11/728,013 on Photoconductor Fluorinated Charge Transport Layers, filed Mar. 23, 2007.

Jin Wu et al., U.S. Appl. No. 11/728,007 on Overcoated Photoconductors Containing Fluorinated Components, filed Mar. 23, 2007.

* cited by examiner

*Primary Examiner*—John L Goodrow
(74) *Attorney, Agent, or Firm*—E. O. Palazzo

(57) ABSTRACT

A photoconductor that includes a first layer, a supporting substrate thereover, a photogenerating layer, and at least one charge transport layer containing at least one charge transport component, and where the first layer is in contact with the supporting substrate on the reverse side thereof, and which first layer is comprised of a fluorinated poly(oxetane) polymer.

32 Claims, No Drawings

ANTICURL BACKSIDE COATING (ACBC) PHOTOCONDUCTORS

CROSS REFERENCE TO RELATED APPLICATIONS

U.S. application Ser. No. 12/033,267, U.S. Publication No. 20090208857, filed Feb. 29, 2008, entitled Overcoat Containing Fluorinated Poly(Oxetane) Photoconductors, the disclosure of which is totally incorporated herein by reference, discloses a photoconductor comprising a supporting substrate, a photogenerating layer, and at least one charge transport layer comprised of at least one charge transport component, and in contact with the charge transport layer an overcoat layer comprised of a polymer, an optional charge transport component, and a fluorinated poly(oxetane) polymer.

U.S. application Ser. No. 12/033,276, U.S. Publication No. 20090208856, filed Feb. 29, 2008, entitled Overcoated Photoconductors, the disclosure of which is totally incorporated herein by reference, discloses a photoconductor comprising an optional supporting substrate, a photogenerating layer, and at least one charge transport layer, and wherein at least one charge transport layer contains at least one charge transport component; and an overcoating layer in contact with and contiguous to the charge transport layer, and which overcoating is comprised of a self crosslinked acrylic resin, a charge transport component, and a low surface energy additive.

U.S. application Ser. No. 12/033,279, U.S. Publication No. 20090208858, filed Feb. 29, 2008, filed concurrently herewith by Jin Wu et al., entitled Backing Layer Containing Photoconductor, the disclosure of which is totally incorporated herein by reference, a photoconductor comprising a substrate, an imaging layer thereon, and a backing layer located on a side of the substrate opposite the imaging layer wherein the outermost layer of the backing layer adjacent to the substrate is comprised of a self crosslinked acrylic resin and a crosslinkable siloxane component.

The following related photoconductor applications are also being recited. The disclosures of each of the following copending applications are totally incorporated herein by reference.

U.S. application Ser. No. 11/593,875, filed Nov. 7, 2006 on Silanol Containing Overcoated Photoconductors, by John F. Yanus et al., which discloses an imaging member comprising an optional supporting substrate, a silanol containing photogenerating layer, and at least one charge transport layer comprised of at least one charge transport component and an overcoating layer in contact with and contiguous to the charge transport, and which overcoating is comprised of an acrylated polyol, a polyalkylene glycol, a crosslinking agent, and a charge transport component.

U.S. application Ser. No. 11/593,657, filed Nov. 7, 2006 on Overcoated Photoconductors With Thiophosphate Containing Charge Transport Layers, which discloses, for example, an imaging member comprising an optional supporting substrate, a photogenerating layer, and at least one charge transport layer, and wherein at least one charge transport layer contains at least one charge transport component and at least one thiophosphate; and an overcoating layer in contact with and contiguous to the charge transport layer, and which overcoating is comprised of an acrylated polyol, a polyalkylene glycol, a crosslinking component, and a charge transport component.

U.S. application Ser. No. 11/593,656, filed Nov. 7, 2006 on Silanol Containing Charge Transport Overcoated Photoconductors, by John F. Yanus et al., which discloses an imaging member comprising an optional supporting substrate, a photogenerating layer, and at least one charge transport layer comprised of at least one charge transport component and at least one silanol; and an overcoating in contact with and contiguous to the charge transport layer, and which overcoating is comprised of an acrylated polyol, a polyalkylene glycol, a crosslinking component, and a charge transport component.

U.S. application Ser. No. 11/593,662, filed Nov. 7, 2006 on Overcoated Photoconductors with Thiophosphate Containing Photogenerating Layer, by John F. Yanus et al., which discloses an imaging member comprising an optional supporting substrate, a photogenerating layer, and at least one charge transport layer, and wherein the photogenerating layer contains at least one thiophosphate, and an overcoating layer in contact with and contiguous to the charge transport layer, and which overcoating is comprised of an acrylated polyol, a polyalkylene glycol, a crosslinking component, and a charge transport component.

U.S. application Ser. No. 11/728,006, filed Mar. 23, 2007 by Jin Wu et al. on Photoconductors Containing Fluorinated Components, discloses a photoconductor comprising a layer comprised of a polymer and a fluoroalkyl ester; thereover a supporting substrate, a photogenerating layer, and at least one charge transport layer.

U.S. application Ser. No. 11/728,013, filed Mar. 23, 2007 by Jin Wu et al. on Photoconductor Fluorinated Charge Transport Layers, discloses a photoconductor comprising an optional supporting substrate, a photogenerating layer, and at least one fluoroalkyl ester containing charge transport layer.

U.S. application Ser. No. 11/728,007, filed Mar. 23, 2007 by Jin Wu et al. on Overcoated Photoconductors Containing Fluorinated Components, discloses a photoconductor comprising an optional supporting substrate, a photogenerating layer, at least one charge transport layer, and an overcoating layer in contact with and contiguous to the charge transport layer, and which overcoating is comprised of a fluoroalkyl ester, and a polymer.

U.S. application Ser. No. 11/961,549, filed Dec. 20, 2007 by Jin Wu et al. on Photoconductors Containing Ketal Overcoats, discloses a photoconductor comprising a supporting substrate, a photogenerating layer, and at least one charge transport layer comprised of at least one charge transport component, and an overcoat layer in contact with and contiguous to the charge transport layer, and which overcoat is comprised of a crosslinked polymeric network, an overcoat charge transport component, and at least one ketal.

BACKGROUND

This disclosure is generally directed to layered imaging members, photoreceptors, photoconductors, and the like. More specifically, the present disclosure is directed to multilayered drum, or flexible, belt imaging members, or devices comprised of a first layer, a supporting medium like a substrate, a photogenerating layer, and a charge transport layer, including a plurality of charge transport layers, such as a first charge transport layer and a second charge transport layer, an optional adhesive layer, an optional hole blocking or undercoat layer, and an optional overcoat layer, and wherein the supporting substrate is situated between the first layer and the photogenerating layer. More specifically, the photoconductors disclosed contain a first anticurl backside coating layer or curl deterring backside coating layer (ACBC) to, for example, render imaging member flatness, and other advantages as illustrated herein, and which layer is in contact with and contiguous to the reverse side of the supporting substrate, that is the side of the substrate that is not in contact with the photogenerating layer, and which first layer, the ACBC layer of the present disclosure, is comprised of a fluorinated, especially a soluble, in for example, an alkylene halide, like methylene chloride, fluorinated poly(oxetane) polymer.

With the soluble fluorinated poly(oxetane) polymer, the ACBC layer possesses a desirable low surface energy, thus the wear resistance of this layer is excellent especially as compared to an ACBC layer without any fluorinated polymer or an ACBC layer containing polytetrafluoroethylene (PTFE). Moreover, the ACBC layer of the present disclosure contains an environmentally suitable non-hazardous soluble fluorinated polymer as compared, for example, to PTFE; the coating solution containing the fluorinated poly(oxetane) polymer is stable for extended time periods, and avoids the use of the undesirable perfluorooctane acid (PFOA) in the preparation of the fluorinated poly(oxetane) polymer; minimal agglomeration of the ACBC layer components thereby increasing the slipperiness of this layer; in place of the micron-sized particles of PTFE, the use of molecularly dispersed (soluble) or microphase-separated (nano-sized domains) additives of fluorinated poly(oxetane) polymer substantially avoid the escape of the polymer particles when the ACBC layer is abraded or worn thus adversely impacting the systems in which the ACBC layer is present; and other advantages as illustrated herein for photoconductors with ACBC layers comprising a fluorinated poly(oxetane) polymer.

Also, in embodiments of the present disclosure there are provided photoconductors containing a fluorinated poly(oxetane) polymer in at least one of the ACBC layer, and an overcoat layer.

In some instances when a flexible layered photoconductor belt is mounted over a belt support module comprising various supporting rollers and backer bars in a xerographic imaging apparatus, the anticurl or reduction in curl backside coating (ACBC), functioning under a normal xerographic machine operation condition, is repeatedly subjected to mechanical sliding contact against the apparatus backer bars and the belt support module rollers to thereby adversely impact the ACBC wear characteristics. Moreover, with a number of known prior art ACBC photoconductor layers formulated to contain non-needle like additives the mechanical interactions against the belt support module components can decrease the lifetime of the photoconductor primarily because of wear and degradation after short time periods.

In embodiments, the photoconductors disclosed include an ACBC (anticurl backside coating) layer on the reverse side of the supporting substrate of a belt photoreceptor. The ACBC layer, which can be solution coated, for example, as a self-adhesive layer on the reverse side of the substrate of the photoreceptor, may comprise a number of suitable fluorinated poly(oxetane) materials such as those components that substantially reduce surface contact friction and prevent or minimize wear/scratch problems for the photoreceptor device. In embodiments, the mechanically robust ACBC layer of the present disclosure usually will not substantially reduce the layer's thickness over extended time periods to adversely affect its anticurl ability for maintaining effective imaging member belt flatness, for example when not flat, the ACBC layer can cause undesirable upward belt curling which adversely impacts imaging member belt surface charging uniformity causing print defects which thereby prevent the imaging process from continuously allowing a satisfactory copy printout quality; moreover, ACBC wear also produces dirt and debris resulting in dusty machine operation condition. Since the ACBC layer is located on the reverse side of the photoconductor, it does not usually adversely interfere with the xerographic performance of the photoconductor, and decouples the mechanical performance from the electrical performance of the photoconductor.

Moreover, high surface contact friction of the anticurl backside coating against the machine, such as printers, subsystems can cause the development of undesirable electrostatic charge buildup. In a number of instances with devices, such as printers, the electrostatic charge builds up because of high contact friction between the anticurl backside coating and the backer bars which increases the frictional force to the point that it requires higher torque from the driving motor to pull the belt for effective cycling motion. In a full color electrophotographic apparatus, using a 10-pitch photoreceptor belt, this electrostatic charge build-up can be high due to the large number of backer bars used in the machine.

Some anticurl backside coating formulations are disclosed in U.S. Pat. Nos. 5,069,993 and 5,021,309.

The anticurl backside coating layers illustrated herein, in embodiments, have excellent wear resistance, extended lifetimes, minimal charge buildup, and permit the elimination or minimization of photoconductive imaging member belt ACBC scratches.

Also included within the scope of the present disclosure are methods of imaging and printing with the photoresponsive or photoconductor devices illustrated herein. These methods generally involve the formation of an electrostatic latent image on the imaging member, followed by developing the image with a toner composition comprised, for example, of thermoplastic resin, colorant, such as pigment, charge additive, and surface additive, reference U.S. Pat. Nos. 4,560,635; 4,298,697 and 4,338,390, the disclosures of which are totally incorporated herein by reference, subsequently transferring the toner image to a suitable image receiving substrate, and permanently affixing the image thereto. In those environments wherein the device is to be used in a printing mode, the imaging method involves the same operation with the exception that exposure can be accomplished with a laser device or image bar. More specifically, the flexible photoconductor belts disclosed herein can be selected for the Xerox Corporation iGEN® machines that generate with some versions over 100 copies per minute. Processes of imaging, especially xerographic imaging and printing, including digital, and/or color printing, are thus encompassed by the present disclosure. The imaging members are in embodiments sensitive in the wavelength region of, for example, from about 400 to about 900 nanometers, and in particular from about 650 to about 850 nanometers, thus diode lasers can be selected as the light source. Moreover, the imaging members of this disclosure are useful in color xerographic applications, particularly high-speed color copying and printing processes.

REFERENCES

There are illustrated in U.S. Pat. No. 6,562,531, the disclosure of which is totally incorporated herein by reference, photoconductors with protective layers containing fillers, such as fillers with certain resistivities, such as alumina, metal oxides, polytetrafluoroethylene, silicone resins, amorphous carbon powders, powders of metals like copper, tin, and the like.

Photoconductors containing ACBC layers are illustrated in U.S. Pat. Nos. 4,654,284; 5,096,795; 5,919,590; 5,935,748; 5,069,993; 5,021,309; 6,303,254; 6,528,226; and 6,939,652.

However, there is a need to create an anticurl backside coating formulation that has intrinsic properties that minimize or eliminate charge accumulation in photoconductors without sacrificing other electrical properties such as low surface energy. One ACBC design can be designated as an insulating polymer coating containing additives, such as silica, PTFE or TEFLON®, to reduce friction against backer plates and rollers, but these additives tend to charge up triboelectrically due to their rubbing against it resulting in electrostatic drag force that adversely affects the process speed of the photoconductor.

There is illustrated in U.S. Pat. No. 6,913,863, the disclosure of which is totally incorporated herein by reference, a photoconductive imaging member comprised of a hole blocking layer, a photogenerating layer, and a charge transport layer, and wherein the hole blocking layer is comprised of a metal oxide; and a mixture of a phenolic compound and a phenolic resin wherein the phenolic compound contains at least two phenolic groups.

Layered photoresponsive imaging members have been described in numerous U.S. patents, such as U.S. Pat. No. 4,265,990, the disclosure of which is totally incorporated herein by reference, wherein there is illustrated an imaging member comprised of a photogenerating layer, and an aryl amine hole transport layer. Examples of photogenerating layer components include trigonal selenium, metal phthalocyanines, vanadyl phthalocyanines, and metal free phthalocyanines. Additionally, there is described in U.S. Pat. No. 3,121,006, the disclosure of which is totally incorporated herein by reference, a composite xerographic photoconductive member comprised of finely divided particles of a photoconductive inorganic compound, and an amine hole transport dispersed in an electrically insulating organic resin binder.

In U.S. Pat. No. 4,587,189, the disclosure of which is totally incorporated herein by reference, there is illustrated a layered imaging member with, for example, a perylene, pigment photogenerating component and an aryl amine component, such as N,N'-diphenyl-N,N'-bis(3-methylphenyl)-1,1'-biphenyl-4,4'-diamine dispersed in a polycarbonate binder as a hole transport layer. The above components, such as the photogenerating compounds and the aryl amine charge transport, can be selected for the imaging members or photoconductors of the present disclosure in embodiments thereof.

Illustrated in U.S. Pat. No. 5,521,306, the disclosure of which is totally incorporated herein by reference, is a process for the preparation of Type V hydroxygallium phthalocyanine comprising the in situ formation of an alkoxy-bridged gallium phthalocyanine dimer, hydrolyzing the dimer to hydroxygallium phthalocyanine, and subsequently converting the hydroxygallium phthalocyanine product to Type V hydroxygallium phthalocyanine.

Illustrated in U.S. Pat. No. 5,482,811, the disclosure of which is totally incorporated herein by reference, is a process for the preparation of hydroxygallium phthalocyanine photogenerating pigments which comprises as a first step hydrolyzing a gallium phthalocyanine precursor pigment by dissolving the hydroxygallium phthalocyanine in a strong acid, and then reprecipitating the resulting dissolved pigment in basic aqueous media.

Also, in U.S. Pat. No. 5,473,064, the disclosure of which is totally incorporated herein by reference, there is illustrated a process for the preparation of photogenerating pigments of hydroxygallium phthalocyanine Type V essentially free of chlorine, whereby a pigment precursor Type I chlorogallium phthalocyanine is prepared by reaction of gallium chloride in a solvent, such as N-methylpyrrolidone, present in an amount of from about 10 parts to about 100 parts, and preferably about 19 parts with 1,3-diiminoisoindolene ($DI^3$) in an amount of from about 1 part to about 10 parts, and preferably about 4 parts of $DI^3$, for each part of gallium chloride that is reacted; hydrolyzing said pigment precursor chlorogallium phthalocyanine Type I by standard methods, for example acid pasting, whereby the pigment precursor is dissolved in concentrated sulfuric acid and then reprecipitated in a solvent, such as water, or a dilute ammonia solution, for example from about 10 to about 15 percent; and subsequently treating the resulting hydrolyzed pigment hydroxygallium phthalocyanine Type I with a solvent, such as N,N-dimethylformamide, present in an amount of from about 1 volume part to about 50 volume parts, and preferably about 15 volume parts for each weight part of pigment hydroxygallium phthalocyanine that is used by, for example, ball milling the Type I hydroxygallium phthalocyanine pigment in the presence of spherical glass beads, approximately 1 millimeter to 5 millimeters in diameter, at room temperature, about 25° C., for a period of from about 12 hours to about 1 week, and preferably about 24 hours.

The appropriate components, such as the supporting substrates, the photogenerating layer components, the charge transport layer components, the overcoating layer components, and the like, of the above-recited patents may be selected for the photoconductors of the present disclosure in embodiments thereof.

SUMMARY

Disclosed are improved imaging members containing a mechanically robust ACBC layer that possesses many of the advantages illustrated herein, such as extended lifetimes of the ACBC photoconductor such as, for example, in excess, it is believed, of about 1,500,000 simulated imaging cycles, and which photoconductors are believed to exhibit ACBC wear and scratch resistance characteristics.

Disclosed are improved imaging members containing an antistatic ACBC layer that minimizes charge accumulation.

Additionally disclosed are improved flexible belt imaging members comprising the disclosed ACBC, and with optional hole blocking layers comprised of, for example, aminosilanes, metal oxides, phenolic resins, and optional phenolic compounds, and which phenolic compounds contain at least two, and more specifically, two to ten phenol groups or phenolic resins with, for example, a weight average molecular weight ranging from about 500 to about 3,000, permitting, for example, a hole blocking layer with excellent efficient electron transport which usually results in a desirable photoconductor low residual potential $V_{low}$.

EMBODIMENTS

Aspects of the present disclosure relate to a photoconductor comprising a first layer, a flexible supporting substrate thereover, a photogenerating layer, and at least one charge transport layer comprised of at least one charge transport component, and wherein the first layer, which is an anticurl backside coating (ACBC) or a layer that minimizes curl, is in contact with the supporting substrate on the reverse side thereof, and which first layer is comprised of a fluorinated poly(oxetane) polymer, a supporting substrate thereover, a photogenerating layer, and at least one charge transport layer comprised of at least one charge transport component; a flexible photoconductive imaging member comprised in sequence of an ACBC layer adhered to the reverse side of the supporting substrate, a supporting substrate, a photogenerating layer thereover, a charge transport layer, and a protective top overcoat layer; and a photoconductor which includes a hole blocking layer and an adhesive layer where the adhesive layer is situated between the hole blocking layer and the photogenerating layer, and the hole blocking layer is situated between the substrate and the adhesive layer.

In aspects thereof, there is disclosed a photoconductor comprising a first layer, a supporting substrate thereover, a photogenerating layer, and at least one charge transport layer comprised of at least one charge transport component, and wherein the first layer is in contact with the supporting substrate on the reverse side thereof, and which first layer is comprised of a fluorinated poly(oxetane) polymer; a photoconductor comprised in sequence of a supporting substrate, a photogenerating layer thereover, and a charge transport layer, and wherein the substrate includes on the reverse side thereof a layer comprised of an additive and a polymer, and wherein the additive is comprised of at least one of the following structures/formulas

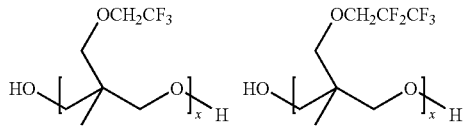

wherein x represents the number of repeating units or segments of from about 3 to about 30; and a photoconductor comprised in sequence of a supporting substrate, a photogenerating layer thereover, and a charge transport layer, and wherein the substrate includes on the reverse side an ACBC layer comprised of a suitable polymer, and dispersed therein a fluorinated poly(oxetane) polymer additive of at least one of the following formulas/structures

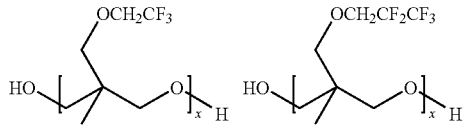

wherein x represents a number of from about 3 to about 50, and which additive is present in an amount of from about 0.5 to about 30 weight percent.

The anticurl backside coating layer with, for example, a thickness of from about 1 to about 100, from about 5 to about 50, or from about 10 to about 30 microns, which embodiment is soluble in a number of solvents, such as for example methylene chloride, such as from about 20 to about 100 percent solubility in methylene chloride, and present in various suitable amounts, such as from about 0.01 to about 20, from about 0.1 to about 15, from 1 to about 10, and from 2 to about 5 weight percent.

The fluorinated poly(oxetane) polymers include, for example, fluorinated poly(oxetane) homopolymers or polyfluorooxetanes, and fluorinated poly(oxetane) copolymers, such as block copolymers of fluorinated poly(oxetane) and olefin polymer or copolymer.

Fluorinated poly(oxetane) homopolymers can be polymerized from a plurality of fluorinated oxetane monomers (cyclic ethers) as illustrated by

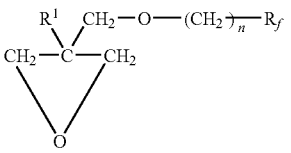

-continued

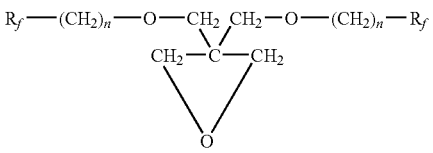

a cationic or anionic mechanism, wherein $R^1$ and $R_f$ is a suitable group like alkyl with, for example, from 1 to 6 carbon atoms or hydrogen, and in embodiments where $R^1$ is methyl; n represents the number of groups and is, for example, independently an integer or number of from 1 to about 6, from 1 to about 4, or from 1 to about 2; $R_f$ is a fluorinated aliphatic group with, for example, from 1 to about 30, from about 3 to about 15, or from about 6 to about 10 carbon atoms, such as for example, fluorinated or perfluorinated methyl, ethyl, n-propyl, isopropyl, n-butyl, isobutyl, pentyl, isopentyl, n-hexyl, derivatives thereof, and the like. A plurality of fluorinated oxetane monomers, whether they contain the same or different $R_f$ groups, $R^1$ groups, or integer n, can be polymerized together. Therefore, in embodiments the fluorinated poly(oxetane) homopolymers disclosed herein can be referred to as copolymers.

The fluorinated poly(oxetane) homopolymers thus formed contain the following repeating units or segments

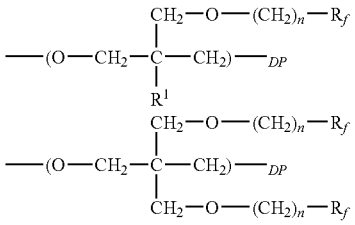

wherein each $R_f$ group, $R^1$ group, and n are as illustrated herein, and DP is degree of polymerization, which represents the number of repeating units of, for example, from 2 to about 100, and from 3 to about 50.

Fluorinated poly(oxetane) copolymers include copolymers, such as block copolymers of a fluorinated poly(oxetane), and an olefin polymer or copolymer derived from at least one olefin monomer having from 2 to about 8 carbon atoms, and block copolymers of a fluorinated poly(oxetane), and a hydrogenated diene polymer or copolymer derived from at least one conjugated diene monomer having from 4 to about 10 carbon atoms. The repeating unit, or degree of polymerization (DP) of the fluorinated poly(oxetane) block is from about 3 to about 50; the number average molecular weight of the olefin polymer or copolymer block is from about 200 to about 4,000; the number average molecular weight of the hydrogenated diene polymer or copolymer block is from about 500 to about 15,000, or from about 1,000 to about 8,000.

Specific examples of the fluorinated poly(oxetane) homopolymers include POLYFOX™ PF-636 (x=6), POLYFOX™ PF-6320 (x=20) with the following structure/formula

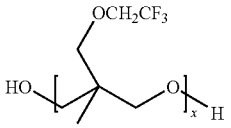

and POLYFOX™ PF-656 (x=6), POLYFOX™ PF-6520 (x=20) with the following structure/formula

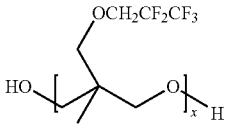

POLYFOX™ additives are commercially available from OMNOVA Solutions Inc., Akron, Ohio.

Other specific examples of the fluorinated poly(oxetane) homopolymers are represented by the following structures/formulas

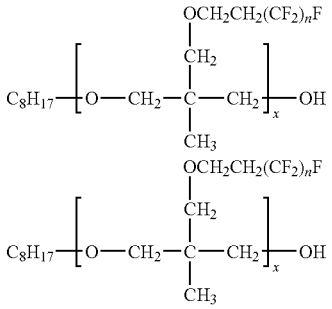

wherein x is about 4.5, and n is about 8; wherein x is about 18, and n is about 8.

A specific example of the fluorinated poly(oxetane) copolymers is represented by the following structure/formula

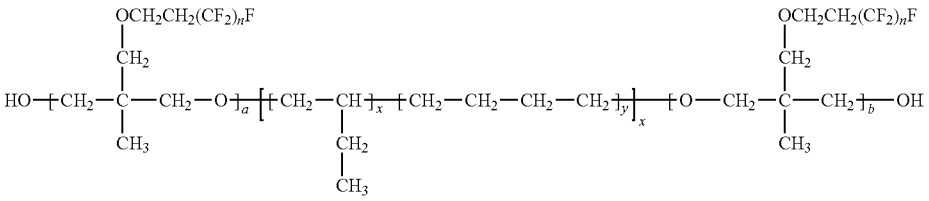

wherein x is about 2; y is about 8; z is about 160; a+b is about 6, and n is about 8.

The above synthesis of the fluorinated poly(oxetane) polymers is environmentally nonhazardous since there is no perfluorooctane acid (PFOA) involved in the process; and also there is believed to be strong interaction between the fluorinated poly(oxetane) polymers and polycarbonates, which tends to retain the fluoro additives across the ACBC layer instead of concentrating it on the surface.

The anticurl backside coating layer further comprises at least one polymer, which usually is the same polymer that is selected for the charge transport layers. Examples of polymers present in an amount of from about 80 to about 99.99, from about 85 to about 99.9, from 90 to about 99, from 95 to about 98 weight percent of the ACBC layer, include polycarbonates, polyarylates, acrylate polymers, vinyl polymers, cellulose polymers, polyesters, polysiloxanes, polyamides, polyurethanes, poly(cyclo olefins), epoxies, and random or alternating copolymers thereof; and more specifically, polycarbonates such as poly(4,4'-isopropylidene-diphenylene) carbonate (also referred to as bisphenol-A-polycarbonate), poly(4,4'-cyclohexylidinediphenylene)carbonate (also referred to as bisphenol-Z-polycarbonate), poly(4,4'-isopropylidene-3,3'-dimethyl-diphenyl)carbonate (also referred to as bisphenol-C-polycarbonate), and the like. In embodiments, the polymeric binder is comprised of a polycarbonate resin with a molecular weight of from about 20,000 to about 100,000, and more specifically, with a molecular weight $M_w$ of from about 50,000 to about 100,000.

The thickness of the photoconductor substrate layer depends on many factors, including economical considerations, electrical characteristics, adequate flexibility, and the like, thus this layer may be of substantial thickness, for example over 3,000 microns, such as from about 1,000 to about 2,000 microns, from about 500 to about 1,000 microns, or from about 300 to about 700 microns, ("about" throughout includes all values in between the values recited) or of a minimum thickness. In embodiments, the thickness of this layer is from about 75 microns to about 300 microns, or from about 100 to about 150 microns.

The photoconductor substrate may be opaque or substantially transparent, and may comprise any suitable material having the required mechanical properties. Accordingly, the substrate may comprise a layer of an electrically nonconductive or conductive material such as an inorganic or an organic composition. As electrically nonconducting materials, there may be employed various resins known for this purpose including polyesters, polycarbonates, polyamides, polyurethanes, and the like, which are flexible as thin webs. An electrically conducting substrate may be any suitable metal of, for example, aluminum, nickel, steel, copper, and the like, or a polymeric material, as described above, filled with an electrically conducting substance, such as carbon, metallic powder, and the like, or an organic electrically conducting material. The electrically insulating or conductive substrate may be in the form of an endless flexible belt, a web, a rigid cylinder, a sheet, and the like. The thickness of the substrate layer depends on numerous factors, including strength desired and economical considerations. For a drum, this layer may be of a substantial thickness of, for example, up to many centimeters, or of a minimum thickness of less than a millimeter. Similarly, a flexible belt may be of a substantial thickness of, for example, about 250 micrometers, or of a minimum thickness of less than about 50 micrometers, provided there are no adverse effects on the final electrophotographic device.

In embodiments where the substrate layer is not conductive, the surface thereof may be rendered electrically conductive by an electrically conductive coating. The conductive coating may vary in thickness over substantially wide ranges depending upon the optical transparency, degree of flexibility desired, and economic factors.

Illustrative examples of substrates are as illustrated herein, and more specifically, supporting substrate layers selected for the imaging members of the present disclosure, and which substrates can be opaque or substantially transparent, comprise a layer of insulating material including inorganic or organic polymeric materials, such as MYLAR® a commercially available polymer, MYLAR® containing titanium, a layer of an organic or inorganic material having a semiconductive surface layer, such as indium tin oxide, or aluminum arranged thereon, or a conductive material inclusive of aluminum, chromium, nickel, brass, or the like. The substrate may be flexible, seamless, or rigid, and may have a number of many different configurations, such as for example, a plate, a cylindrical drum, a scroll, an endless flexible belt, and the like. In embodiments, the substrate is in the form of a seamless flexible belt. In some situations, it may be desirable to coat on the back of the substrate, particularly when the substrate is a flexible organic polymeric material, an anticurl layer, such as for example polycarbonate materials commercially available as MAKROLON®.

Generally, the photogenerating layer can contain known photogenerating pigments, such as metal phthalocyanines, metal free phthalocyanines, alkylhydroxyl gallium phthalocyanines, hydroxygallium phthalocyanines, chlorogallium phthalocyanines, perylenes, especially bis(benzimidazo) perylene, titanyl phthalocyanines, and the like, and more specifically, vanadyl phthalocyanines, Type V hydroxygallium phthalocyanines, and inorganic components such as selenium, selenium alloys, and trigonal selenium. The photogenerating pigment can be dispersed in a resin binder similar to the resin binders selected for the charge transport layer, or alternatively no resin binder need be present. Generally, the thickness of the photogenerating layer depends on a number of factors, including the thicknesses of the other layers and the amount of photogenerating material contained in the photogenerating layer. Accordingly, this layer can be of a thickness of, for example, from about 0.05 micron to about 10 microns, and more specifically, from about 0.25 micron to about 2 microns when, for example, the photogenerating compositions are present in an amount of from about 30 to about 75 percent by volume. The maximum thickness of this layer in embodiments is dependent primarily upon factors, such as photosensitivity, electrical properties and mechanical considerations.

The photogenerating composition or pigment is present in the resinous binder composition in various amounts. Generally, however, from about 5 percent by volume to about 95 percent by volume of the photogenerating pigment is dispersed in about 95 percent by volume to about 5 percent by volume of the resinous binder, or from about 20 percent by volume to about 30 percent by volume of the photogenerating pigment is dispersed in about 70 percent by volume to about 80 percent by volume of the resinous binder composition. In one embodiment, about 90 percent by volume of the photogenerating pigment is dispersed in about 10 percent by volume of the resinous binder composition, and which resin may be selected from a number of known polymers, such as poly (vinyl butyral), poly(vinyl carbazole), polyesters, polycarbonates, poly(vinyl chloride), polyacrylates and methacrylates, copolymers of vinyl chloride and vinyl acetate, phenolic resins, polyurethanes, poly(vinyl alcohol), polyacrylonitrile, polystyrene, and the like. It is desirable to select a coating solvent that does not substantially disturb or adversely affect the other previously coated layers of the device. Examples of coating solvents for the photogenerating layer are ketones, alcohols, aromatic hydrocarbons, halogenated aliphatic hydrocarbons, ethers, amines, amides, esters, and the like. Specific solvent examples are cyclohexanone, acetone, methyl ethyl ketone, methanol, ethanol, butanol, amyl alcohol, toluene, xylene, chlorobenzene, carbon tetrachloride, chloroform, methylene chloride, trichloroethylene, tetrahydrofuran, dioxane, diethyl ether, dimethyl formamide, dimethyl acetamide, butyl acetate, ethyl acetate, methoxyethyl acetate, and the like.

The photogenerating layer may comprise amorphous films of selenium and alloys of selenium and arsenic, tellurium, germanium, and the like, hydrogenated amorphous silicon and compounds of silicon and germanium, carbon, oxygen, nitrogen and the like fabricated by vacuum evaporation or deposition. The photogenerating layers may also comprise inorganic pigments of crystalline selenium and its alloys; Groups II to VI compounds; and organic pigments such as quinacridones, polycyclic pigments such as dibromo anthanthrone pigments, perylene and perinone diamines, polynuclear aromatic quinones, azo pigments including bis-, tris- and tetrakis-azos, and the like dispersed in a film forming polymeric binder and fabricated by solvent coating techniques.

In embodiments, examples of polymeric binder materials that can be selected as the matrix for the photogenerating layer are thermoplastic and thermosetting resins, such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, poly(phenylene sulfides), poly(vinyl acetate), polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, poly(vinyl chloride), vinyl chloride and vinyl acetate copolymers, acrylate copolymers, alkyd resins, cellulosic film formers, poly(amideimide), styrene-butadiene copolymers, vinylidene chloride-vinyl chloride copolymers, vinyl acetate-vinylidene chloride copolymers, styrene-alkyd resins, poly(vinyl carbazole), and the like. These polymers may be block, random or alternating copolymers.

Various suitable and conventional known processes may be used to mix, and thereafter apply the photogenerating layer coating mixture, like spraying, dip coating, roll coating, wire wound rod coating, vacuum sublimation, and the like. For some applications, the photogenerating layer may be fabricated in a dot or line pattern. Removal of the solvent of a solvent-coated layer may be effected by any known conventional techniques such as oven drying, infrared radiation drying, air drying, and the like.

The coating of the photogenerating layer in embodiments of the present disclosure can be accomplished with spray, dip or wire-bar methods such that the final dry thickness of the photogenerating layer is as illustrated herein, and can be, for example, from about 0.01 to about 30 microns after being dried at, for example, about 40° C. to about 150° C. for about 15 to about 90 minutes. More specifically, a photogenerating layer of a thickness, for example, of from about 0.1 to about 30, or from about 0.5 to about 2 microns can be applied to or deposited on the substrate, on other surfaces in between the substrate and the charge transport layer, and the like. A charge blocking layer or hole blocking layer may optionally be applied to the electrically conductive surface prior to the application of a photogenerating layer. When desired, an adhesive layer may be included between the charge blocking or hole blocking layer, or interfacial layer and the photogenerating layer. Usually, the photogenerating layer is applied onto the blocking layer and a charge transport layer or plurality of charge transport layers are formed on the photogenerating layer. This structure may have the photogenerating layer on top of or below the charge transport layer.

In embodiments, a suitable known adhesive layer can be included in the photoconductor. Typical adhesive layer materials include, for example, polyesters, polyurethanes, and the like. The adhesive layer thickness can vary and in embodiments is, for example, from about 0.05 micrometer (500 Angstroms) to about 0.3 micrometer (3,000 Angstroms). The adhesive layer can be deposited on the hole blocking layer by spraying, dip coating, roll coating, wire wound rod coating, gravure coating, Bird applicator coating, and the like. Drying of the deposited coating may be effected by, for example, oven drying, infrared radiation drying, air drying, and the like.

As optional adhesive layers usually in contact with or situated between the hole blocking layer and the photogenerating layer, there can be selected various known substances inclusive of copolyesters, polyamides, poly(vinyl butyral), poly (vinyl alcohol), polyurethane, and polyacrylonitrile. This layer is, for example, of a thickness of from about 0.001 micron to about 1 micron, or from about 0.1 to about 0.5 micron. Optionally, this layer may contain effective suitable amounts, for example from about 1 to about 10 weight percent, of conductive and nonconductive particles, such as zinc oxide, titanium dioxide, silicon nitride, carbon black, and the like, to provide, for example, in embodiments of the present disclosure further desirable electrical and optical properties.

The hole blocking or undercoat layers for the imaging members of the present disclosure can contain a number of components including known hole blocking components, such as amino silanes, doped metal oxides, TiSi, a metal oxide like titanium, chromium, zinc, tin, and the like; a mixture of phenolic compounds and a phenolic resin or a mixture of two phenolic resins, and optionally a dopant such as $SiO_2$. The phenolic compounds usually contain at least two phenol groups, such as bisphenol A (4,4'-isopropylidenediphenol), E (4,4'-ethylidenebisphenol), F (bis(4-hydroxyphenyl)methane), M (4,4'-(1,3-phenylenediisopropylidene)bisphenol), P (4,4'-(1,4-phenylene diisopropylidene)bisphenol), S (4,4'-sulfonyldiphenol), and Z (4,4'-cyclohexylidenebisphenol); hexafluorobisphenol A (4,4'-(hexafluoro isopropylidene) diphenol), resorcinol, hydroxyquinone, catechin, and the like.

The hole blocking layer can be, for example, comprised of from about 20 weight percent to about 80 weight percent, and more specifically, from about 55 weight percent to about 65 weight percent of a suitable component like a metal oxide, such as $TiO_2$, from about 20 weight percent to about 70 weight percent, and more specifically, from about 25 weight percent to about 50 weight percent of a phenolic resin; from about 2 weight percent to about 20 weight percent, and more specifically, from about 5 weight percent to about 15 weight percent of a phenolic compound preferably containing at least two phenolic groups, such as bisphenol S, and from about 2 weight percent to about 15 weight percent, and more specifically, from about 4 weight percent to about 10 weight percent of a plywood suppression dopant, such as $SiO_2$. The hole blocking layer coating dispersion can, for example, be prepared as follows. The metal oxide/phenolic resin dispersion is first prepared by ball milling or dynomilling until the median particle size of the metal oxide in the dispersion is less than about 10 nanometers, for example from about 5 to about 9. To the above dispersion are added a phenolic compound and dopant, followed by mixing. The hole blocking layer coating dispersion can be applied by dip coating or web coating, and the layer can be thermally cured after coating. The hole blocking layer resulting is, for example, of a thickness of from about 0.01 micron to about 30 microns, and more specifically, from about 0.1 micron to about 8 microns. Examples of phenolic resins include formaldehyde polymers with phenol, p-tert-butylphenol, cresol, such as VARCUM™ 29159 and 29101 (available from OxyChem Company), and DURITE™ 97 (available from Borden Chemical); formaldehyde polymers with ammonia, cresol, and phenol, such as VARCUM™ 29112 (available from OxyChem Company); formaldehyde polymers with 4,4'-(1-methylethylidene)bisphenol, such as VARCUM™ 29108 and 29116 (available from OxyChem Company); formaldehyde polymers with cresol and phenol, such as VARCUM™ 29457 (available from OxyChem Company), DURITE™ SD-423A, SD-422A (available from Borden Chemical); or formaldehyde polymers with phenol and p-tert-butylphenol, such as DURITE™ ESD 556C (available from Border Chemical).

The optional hole blocking layer may be applied to the substrate. Any suitable and conventional blocking layer capable of forming an electronic barrier to holes between the adjacent photoconductive layer (or electrophotographic imaging layer) and the underlying conductive surface of substrate may be selected.

A number of charge transport compounds can be included in the charge transport layer, which layer generally is of a thickness of from about 5 microns to about 75 microns, and more specifically, of a thickness of from about 10 microns to about 40 microns. Examples of charge transport components are aryl amines of the following formulas/structures

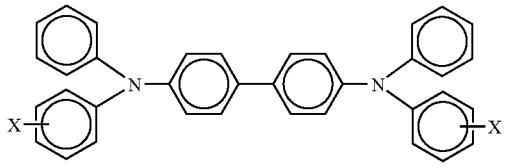

and

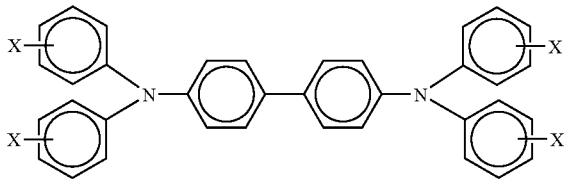

wherein X is a suitable hydrocarbon like alkyl, alkoxy, aryl, and derivatives thereof; a halogen, or mixtures thereof, and especially those substituents selected from the group consisting of Cl and $CH_3$; and molecules of the following formulas/structures

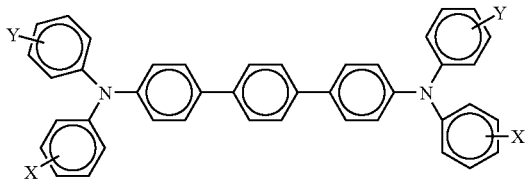

-continued and

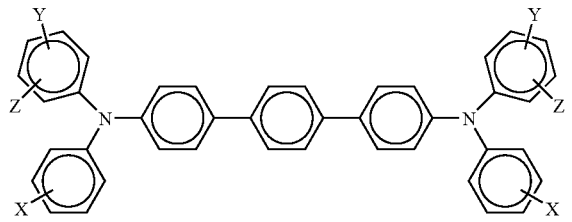

wherein X, Y and Z are independently alkyl, alkoxy, aryl, a halogen, or mixtures thereof; and wherein at least one of Y and Z are present. Alkyl and alkoxy contain, for example, from 1 to about 25 carbon atoms, and more specifically, from 1 to about 12 carbon atoms, such as methyl, ethyl, propyl, butyl, pentyl, and the corresponding alkoxides. Aryl can contain from 6 to about 36 carbon atoms, such as phenyl, and the like. Halogen includes chloride, bromide, iodide, and fluoride. Substituted alkyls, alkoxys, and aryls can also be selected in embodiments.

Examples of specific aryl amines include N,N'-diphenyl-N,N'-bis(alkylphenyl)-1,1-biphenyl-4,4'-diamine wherein alkyl is selected from the group consisting of methyl, ethyl, propyl, butyl, hexyl, and the like; N,N'-diphenyl-N,N'-bis (halophenyl)-1,1'-biphenyl-4,4'-diamine wherein the halo substituent is a chloro substituent; N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4'-diamine, N,N'-diphenyl-N,N'-bis(3-chlorophenyl)-[p-terphenyl]-4,4"-diamine, and the like. Other known charge transport layer molecules can be selected, reference for example, U.S. Pat. Nos. 4,921,773 and 4,464,450, the disclosures of which are totally incorporated herein by reference.

Examples of the binder materials selected for the charge transport layers include polycarbonates, polyarylates, acrylate polymers, vinyl polymers, cellulose polymers, polyesters, polysiloxanes, polyamides, polyurethanes, poly(cyclo olefins), epoxies, and random or alternating copolymers thereof; and more specifically, polycarbonates such as poly (4,4'-isopropylidene-diphenylene) carbonate (also referred to as bisphenol-A-polycarbonate), poly(4,4'-cyclohexylidine-diphenylene)carbonate (also referred to as bisphenol-Z-polycarbonate), poly(4,4'-isopropylidene-3,3'-dimethyl-diphenyl) carbonate (also referred to as bisphenol-C-polycarbonate), and the like. In embodiments, electrically inactive binders are comprised of polycarbonate resins with a molecular weight of from about 20,000 to about 100,000, or with a molecular weight $M_w$ of from about 50,000 to about 100,000. Generally, the transport layer contains from about 10 to about 75 percent by weight of the charge transport material, and more specifically, from about 35 percent to about 50 percent of this material.

The charge transport layer or layers, and more specifically, a first charge transport in contact with the photogenerating layer, and thereover a top or second charge transport overcoating layer, may comprise charge transporting small molecules dissolved or molecularly dispersed in a film forming electrically inert polymer such as a polycarbonate. In embodiments, "dissolved" refers, for example, to forming a solution in which the small molecule is dissolved in the polymer to form a homogeneous phase; and "molecularly dispersed in embodiments" refers, for example, to charge transporting molecules dispersed in the polymer, the small molecules being dispersed in the polymer on a molecular scale. Various charge transporting or electrically active small molecules may be selected for the charge transport layer or layers. In embodiments, "charge transport" refers, for example, to charge transporting molecules as a monomer that allows the free charge generated in the photogenerating layer to be transported across the transport layer.

Examples of hole transporting molecules present, for example, in an amount of from about 50 to about 75 weight percent, include, for example, pyrazolines such as 1-phenyl-3-(4'-diethylamino styryl)-5-(4"-diethylamino phenyl)pyrazoline; aryl amines such as N,N'-diphenyl-N,N'-bis(3-methylphenyl)-(1,1'-biphenyl)-4,4'-diamine, N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, N,N'-diphenyl-N,N'-bis(3-chlorophenyl)-[p-terphenyl]-4,4"-diamine; hydrazones such as N-phenyl-N-methyl-3-(9-ethyl) carbazyl hydrazone and 4-diethyl amino benzaldehyde-1,2-diphenyl hydrazone; and oxadiazoles such as 2,5-bis(4-N,N'-diethylaminophenyl)-1,2,4-oxadiazole, stilbenes, and the like. However, in embodiments, to minimize or avoid cycle-up in equipment, such as printers, with high throughput, the charge transport layer should be substantially free (less than about two percent) of di or triamino-triphenyl methane. A small molecule charge transporting compound that permits injection of holes into the photogenerating layer with high efficiency and transports them across the charge transport layer with short transit times includes N,N'-diphenyl-N,N'-bis(3-methylphenyl)-(1,1'-biphenyl)-4,4'-diamine, N,N'-bis (4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, and N,N'-diphenyl-N,N'-bis(3-chlorophenyl)-[p-terphenyl]-4,4"-diamine, or mixtures thereof. If desired, the charge transport material in the charge transport layer may comprise a polymeric charge transport material, or a combination of a small molecule charge transport material and a polymeric charge transport material.

Examples of components or materials optionally incorporated into the charge transport layers or at least one charge transport layer to, for example, enable improved lateral charge migration (LCM) resistance include hindered phenolic antioxidants, such as tetrakis methylene(3,5-di-tert-butyl-4-hydroxy hydrocinnamate) methane (IRGANOX™ 1010, available from Ciba Specialty Chemical), butylated hydroxytoluene (BHT), and other hindered phenolic antioxidants including SUMILIZER™ BHT-R, MDP-S, BBM-S, WX-R, NR, BP-76, BP-101, GA-80, GM and GS (available from Sumitomo Chemical Co., Ltd.), IRGANOX™ 1035, 1076, 1098, 1135, 1141, 1222, 1330, 1425WL, 1520L, 245, 259, 3114, 3790, 5057 and 565 (available from Ciba Specialties Chemicals), and ADEKA STAB™ AO-20, AO-30, AO-40, AO-50, AO-60, AO-70, AO-80 and AO-330 (available from Asahi Denka Co., Ltd.); hindered amine antioxidants such as SANOL™ LS-2626, LS-765, LS-770 and LS-744 (available from SNKYO CO., Ltd.), TINUVIN™ 144 and 622LD (available from Ciba Specialties Chemicals), MARK™ LA57, LA67, LA62, LA68 and LA63 (available from Asahi Denka Co., Ltd.), and SUMILIZER™ TPS (available from Sumitomo Chemical Co., Ltd.); thioether antioxidants such as SUMILIZER™ TP-D (available from Sumitomo Chemical Co., Ltd); phosphite antioxidants such as MARK™ 2112, PEP-8, PEP-24G, PEP-36, 329K and HP-10 (available from Asahi Denka Co., Ltd.); other molecules such as bis(4-diethylamino-2-methylphenyl) phenylmethane (BDETPM), bis-[2-methyl-4-(N-2-hydroxyethyl-N-ethylaminophenyl)]-phenylmethane (DHTPM), and the like. The weight percent of the antioxidant in at least one of the charge transport layers is from about 0 to about 20, from about 1 to about 10, or from about 3 to about 8 weight percent.

A number of processes may be used to mix, and thereafter apply the charge transport layer or layers coating mixture to the photogenerating layer. Typical application techniques include spraying, dip coating, roll coating, wire wound rod coating, and the like. Drying of the charge transport deposited coating may be effected by any suitable conventional technique such as oven drying, infrared radiation drying, air drying, and the like.

The thickness of each of the charge transport layer in embodiments is from about 10 to about 70 micrometers, but thicknesses outside this range may, in embodiments, also be selected. The charge transport layer should be an insulator to the extent that an electrostatic charge placed on the hole transport layer is not conducted in the absence of illumination at a rate sufficient to prevent formation and retention of an electrostatic latent image thereon. In general, the ratio of the thickness of the charge transport layer to the photogenerating layer can be from about 2:1 to 200:1, and in some instances 400:1. The charge transport layer is substantially nonabsorbing to visible light or radiation in the region of intended use, but is electrically "active" in that it allows the injection of photogenerated holes from the photoconductive layer, or photogenerating layer, and allows these holes to be transported through itself to selectively discharge a surface charge on the surface of the active layer. Typical application techniques include spraying, dip coating, roll coating, wire wound rod coating, and the like. Drying of the deposited coating may be effected by any suitable conventional technique, such as oven drying, infrared radiation drying, air drying, and the like. An optional top overcoating layer, such as the overcoating of copending U.S. application Ser. No. 11/593,875, the disclosure of which is totally incorporated herein by reference, may be applied over the charge transport layer to provide abrasion protection.

Aspects of the present disclosure relate to a photoconductive imaging member comprised of a first ACBC layer, a supporting substrate, a photogenerating layer, a charge transport layer, and an overcoating charge transport layer; a photoconductive member with a photogenerating layer of a thickness of from about 0.1 to about 10 microns, and at least one transport layer, each of a thickness of from about 5 to about 100 microns; an imaging method and an imaging apparatus containing a charging component, a development component, a transfer component, and a fixing component, and wherein the apparatus contains a photoconductive imaging member comprised of a first layer, a supporting substrate, and thereover a layer comprised of a photogenerating pigment and a charge transport layer or layers, and thereover an overcoat charge transport layer, and where the transport layer is of a thickness of from about 40 to about 75 microns; a member wherein the photogenerating layer contains a photogenerating pigment present in an amount of from about 5 to about 95 weight percent; a member wherein the thickness of the photogenerating layer is from about 0.1 to about 4 microns; a member wherein the photogenerating layer contains a polymer binder; a member wherein the binder is present in an amount of from about 50 to about 90 percent by weight, and wherein the total of all layer components is about 100 percent; a member wherein the photogenerating component is a hydroxygallium phthalocyanine that absorbs light of a wavelength of from about 370 to about 950 nanometers; an imaging member wherein the supporting substrate is comprised of a conductive substrate comprised of a metal; an imaging member wherein the conductive substrate is aluminum, aluminized polyethylene terephthalate or titanized polyethylene terephthalate; an imaging member wherein the photogenerating resinous binder is selected from the group consisting of polyesters, polyvinyl butyrals, polycarbonates, polystyrene-b-polyvinyl pyridine, and polyvinyl formals; an imaging member wherein the photogenerating pigment is a metal free phthalocyanine; an imaging member wherein each of the charge transport layers comprises

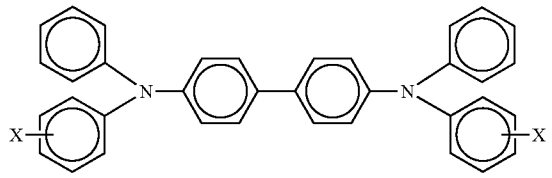

wherein X is selected from the group consisting of alkyl, alkoxy, aryl, and halogen; an imaging member wherein alkyl and alkoxy contains from about 1 to about 12 carbon atoms; an imaging member wherein alkyl contains from about 1 to about 5 carbon atoms; an imaging member wherein alkyl is methyl; an imaging member wherein each of, or at least one of the charge transport layers comprises

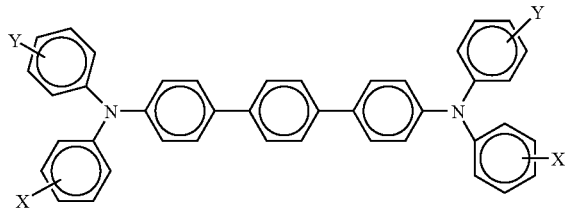

wherein X and Y are independently alkyl, alkoxy, aryl, a halogen, or mixtures thereof; an imaging member wherein alkyl and alkoxy contains from about 1 to about 12 carbon atoms; an imaging member wherein alkyl contains from about 1 to about 5 carbon atoms, and wherein the resinous binder is selected from the group consisting of polycarbonates and polystyrene; an imaging member wherein the photogenerating pigment present in the photogenerating layer is comprised of chlorogallium phthalocyanine, or Type V hydroxygallium phthalocyanine prepared by hydrolyzing a gallium phthalocyanine precursor by dissolving the hydroxygallium phthalocyanine in a strong acid, and then reprecipitating the resulting dissolved precursor in a basic aqueous media; removing any ionic species formed by washing with water; concentrating the resulting aqueous slurry comprised of water and hydroxygallium phthalocyanine to a wet cake; removing water from the wet cake by drying; and subjecting the resulting dry pigment to mixing with the addition of a second solvent to cause the formation of the hydroxygallium phthalocyanine; an imaging member wherein the Type V hydroxygallium phthalocyanine has major peaks, as measured with an X-ray diffractometer, at Bragg angles (2 theta+/−0.2°) 7.4, 9.8, 12.4, 16.2, 17.6, 18.4, 21.9, 23.9, 25.0, 28.1 degrees, and the highest peak at 7.4 degrees; a method of imaging, which comprises generating an electrostatic latent image on an imaging member, developing the latent image, and transferring the developed electrostatic image to a suitable substrate; a method of imaging wherein the imaging member is exposed to light of a wavelength of from about 370 to about 950 nanometers; a photoconductive member wherein the photogenerating layer is situated between the substrate and the charge transport layer; a member wherein the charge transport layer is situated between the substrate and the photogenerating layer; a member wherein the photogenerating layer is of a thickness of from about 0.1 to about 50 microns; a member wherein the photogenerating component amount is from about 0.5 weight percent to about 20 weight percent, and wherein the photogenerating pigment is optionally dispersed in from about 1 weight percent to about 80 weight percent of a polymer binder; a member wherein the binder is present in an amount of from about 50 to about 90 percent by weight, and wherein the total of the layer components is about 100 percent; an imaging member wherein the photogenerating component is Type V hydroxygallium phthalocyanine, or chlorogallium phthalocyanine, and the charge transport layer contains a hole transport of N,N'-diphenyl-N,N-bis(3-methylphenyl)-1,1'-biphenyl-4,4'-diamine, N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, N,N'-diphenyl-N,N'-bis(3-chlorophenyl)-[p-terphenyl]-4,4"-diamine molecules, and wherein the hole transport resinous binder is selected from the group consisting of polycarbonates and polystyrene; an imaging member wherein the photogenerating layer contains a metal free phthalocyanine; an imaging member wherein the photogenerating layer contains an alkoxygallium phthalocyanine; a photoconductive imaging member with a blocking layer contained as a coating on a substrate, and an adhesive layer coated on the blocking layer; a color method of imaging which comprises generating an electrostatic latent image on the imaging member, developing the latent image, transferring and fixing the developed electrostatic image to a suitable substrate; photoconductive imaging members comprised of a supporting substrate, a photogenerating layer, a hole transport layer and a top overcoating layer in contact with the hole transport layer or in embodiments in contact with the photogenerating layer, and in embodiments wherein a plurality of charge transport layers are selected, such as for example, from two to about ten, and more specifically, two may be selected; and a photoconductive imaging member comprised of an optional supporting substrate, a photogenerating layer, and a first, second, and third charge transport layer.

The following Examples are being submitted to illustrate embodiments of the present disclosure.

COMPARATIVE EXAMPLE 1

A controlled anticurl backside coating layer (ACBC) solution was prepared by introducing into an amber glass bottle in a weight ratio of 8:92 VITEL® 2200, a copolyester of iso/terephthalic acid, dimethylpropanediol, and ethanediol having a melting point of from about 302° C. to about 320° C. (degrees Centigrade), commercially available from Shell Oil Company, Houston, Tex., and MAKROLON® 5705, a known polycarbonate resin having a $M_w$ molecular weight average of from about 50,000 to about 100,000, commercially available from Farbenfabriken Bayer A.G. The resulting mixture was then dissolved in methylene chloride to form a solution containing 9 percent by weight solids. This solution was applied on the back of the substrate, a biaxially oriented polyethylene naphthalate substrate (KALEDEX™ 2000) having a thickness of 3.5 mils, to form a coating of the anticurl backside coating layer that upon drying (120° C. for 1 minute) had a thickness of 17.4 microns. During this coating process, the humidity was equal to or less than 15 percent, and thereover a 0.02 micron thick titanium layer coated (the coater device) on a biaxially oriented polyethylene naphthalate substrate (KALEDEX™ 2000) having a thickness of 3.5 mils, and applying thereon, with a gravure applicator or an extrusion coater, a hole blocking layer solution containing 50 grams of 3-aminopropyl triethoxysilane (γ-APS), 41.2 grams of water, 15 grams of acetic acid, 684.8 grams of denatured alcohol, and 200 grams of heptane. This layer was then dried for about 1 minute at 120° C. in the forced air dryer of the coater. The resulting hole blocking layer had a dry thickness of 500 Angstroms. An adhesive layer was then prepared by applying a wet coating over the blocking layer using a gravure applicator or an extrusion coater, and which adhesive contained 0.2 percent by weight based on the total weight of the solution of copolyester adhesive (ARDEL™ D100 available from Toyota Hsutsu Inc.) in a 60:30:10 volume ratio mixture of tetrahydrofuran/monochlorobenzene/methylene chloride. The adhesive layer was then dried for about 1 minute at 120° C. in the forced air dryer of the coater. The resulting adhesive layer had a dry thickness of 200 Angstroms.

A photogenerating layer dispersion was prepared by introducing 0.45 gram of the known polycarbonate IUPILON™ 200 (PCZ-200) or POLYCARBONATE Z, weight average molecular weight of 20,000, available from Mitsubishi Gas Chemical Corporation, and 50 milliliters of tetrahydrofuran into a 4 ounce glass bottle. To this solution were added 2.4 grams of hydroxygallium phthalocyanine (Type V) and 300 grams of ⅛ inch (3.2 millimeters) diameter stainless steel shot. This mixture was then placed on a ball mill for 8 hours. Subsequently, 2.25 grams of PCZ-200 were dissolved in 46.1 grams of tetrahydrofuran, and added to the hydroxygallium phthalocyanine dispersion. This slurry was then placed on a shaker for 10 minutes. The resulting dispersion was, thereafter, applied to the above adhesive interface with a Bird applicator to form a photogenerating layer having a wet thickness of 0.25 mil. A strip about 10 millimeters wide along one edge of the substrate web bearing the blocking layer and the adhesive layer was deliberately left uncoated by any of the photogenerating layer material to facilitate adequate electrical contact by the ground strip layer that was applied later. The photogenerating layer was dried at 120° C. for 1 minute in a forced air oven to form a dry photogenerating layer having a thickness of 0.4 micron.

The photoconductor imaging member web was then coated over with two charge transport layers. Specifically, the photogenerating layer was overcoated with a charge transport layer (the bottom layer) in contact with the photogenerating layer. The bottom layer of the charge transport layer was prepared by introducing into an amber glass bottle in a weight ratio of 1:1 N,N'-diphenyl-N,N'-bis(3-methylphenyl)-1,1'-biphenyl-4,4'-diamine, and poly(4,4'-isopropylidene diphenyl) carbonate, a known bisphenol A polycarbonate having a $M_w$ molecular weight average of about 120,000, commercially available from Farbenfabriken Bayer A.G. as MAKROLON® 5705. The resulting mixture was then dissolved in methylene chloride to form a solution containing 15 percent by weight solids. This solution was applied on the photogenerating layer to form the bottom layer coating that upon drying (120° C. for 1 minute) had a thickness of 14.5 microns. During this coating process, the humidity was equal to or less than 15 percent.

The bottom layer of the charge transport layer was then overcoated with a top layer. The charge transport layer solution of the top layer was prepared as described above for the bottom layer. This solution was applied on the bottom layer of the charge transport layer to form a coating that upon drying (120° C. for 1 minute) had a thickness of 14.5 microns. During this coating process, the humidity was equal to or less than 15 percent.

COMPARATIVE EXAMPLE 2

A photoconductor was prepared by repeating the process of Comparative Example 1 except that the ACBC layer coating dispersion was prepared by adding polytetrafluoroethylene (PTFE) MP-1100 (DuPont) into the ACBC coating solution of Comparative Example 1, and milling with 2 millimeter stainless shots at 200 rpm for 20 hours, and the resulting ACBC coating dispersion had the formulation of VITEL® 2200/MAKROLON® 5705/PTFE MP-1100=7.3/83.6/9.1 in methylene chloride with 9.7 weight percent of the solid. This dispersion was applied on the back of the substrate, a biaxially oriented polyethylene naphthalate substrate (KALEDEX™ 2000) having a thickness of 3.5 mils, to form a coating of the anticurl backside coating layer that upon drying (120° C. for 1 minute) had a thickness of 18.7 microns. During this coating process the humidity was equal to or less than 15 percent.

EXAMPLE I

A photoconductor was prepared by repeating the process of Comparative Example 1 except that the ACBC layer solution was prepared by adding to the above Comparative Example 1 ACBC layer solution 1 percent by weight of the following fluorinated poly(oxetane) polymer additive

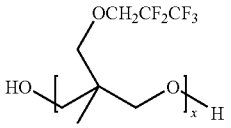

wherein x is 20, as obtained from OMNOVA Solutions Inc. of Akron, Ohio, as POLYFOX™ PF-6520 (100 percent soluble in methylene chloride). This solution which was applied on the back of the substrate biaxially oriented polyethylene naphthalate substrate (KALEDEX™ 2000) having a thickness of 3.5 mils formed a coating of the anticurl backside (ACBC) coating layer that upon drying (120° C. for 1 minute) had a thickness of 17.6 microns. During this coating process, the humidity was equal to or less than 15 percent.

EXAMPLE II

A photoconductor was prepared by repeating the process of Comparative Example 1 except that to the above Comparative Example 1 ACBC layer solution 5 percent by weight of the following fluorinated poly(oxetane) polymer was added

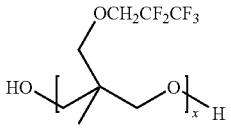

wherein x is 20, as obtained from OMNOVA Solutions Inc. of Akron, Ohio, as POLYFOX™ PF-6520. This solution was applied on the back of the substrate, a biaxially oriented polyethylene naphthalate substrate (KALEDEX™ 2000) having a thickness of 3.5 mils, to form a coating of the anticurl backside coating layer that upon drying (120° C. for 1 minute) had a thickness of 18.3 microns. During this coating process, the humidity was equal to or less than 15 percent.

EXAMPLE III

A photoconductor is prepared by repeating the process of Comparative Example 1 except that to the above Comparative Example 1 ACBC layer solution 3 percent by weight of the following fluorinated poly(oxetane) polymer is added

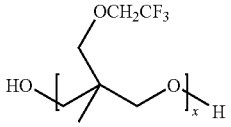

wherein x is 20, as obtained from OMNOVA Solutions Inc. of Akron, Ohio, as POLYFOX™ PF-6320. This solution is applied on the back of the substrate, a biaxially oriented polyethylene naphthalate substrate (KALEDEX™ 2000) having a thickness of 3.5 mils, to form a coating of the anticurl backside coating layer that upon drying (120° C. for 1 minute) had a thickness of 17.9 microns. During this coating process, the humidity is equal to or less than 15 percent.

EXAMPLE IV

A photoconductor is prepared by repeating the process of Comparative Example 1 except that to the above Comparative Example 1 ACBC layer solution 10 percent by weight of the following fluorinated poly(oxetane) polymer is added

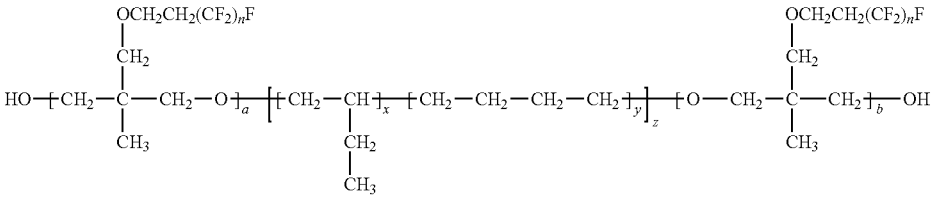

wherein x is 2; y is 8; z is 160; a+b is 6, and n is 8. This solution is applied on the back of the substrate, a biaxially oriented polyethylene naphthalate substrate (KALEDEX™ 2000) having a thickness of 3.5 mils, to form a coating of the anticurl backside coating layer that upon drying (120° C. for 1 minute) had a thickness of 19.1 microns. During this coating process, the humidity is equal to or less than 15 percent.

EXAMPLE V

A photoconductor is prepared by repeating the process of Comparative Example 1 except that to the above Comparative Example 1 ACBC layer solution 10 percent by weight of the following fluorinated poly(oxetane) polymer is added

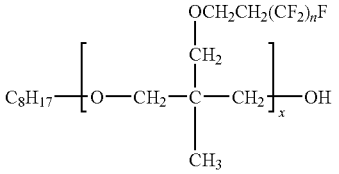

wherein x is 4.5, and n is 8. This solution is applied on the back of the substrate, a biaxially oriented polyethylene naphthalate substrate (KALEDEX™ 2000) having a thickness of 3.5 mils, to form a coating of the anticurl backside coating layer that upon drying (120° C. for 1 minute) had a thickness of 19.1 microns. During this coating process, the humidity is equal to or less than 15 percent.

Contact Angle Measurements

The advancing contact angles of deionized water on the ACBC layers of Comparative Examples 1 and 2, and Examples I and II photoconductors were measured at ambient temperature (about 23° C.) using Contact Angle System OCA (Dataphysics Instruments GmbH, model OCA15). At least ten measurements are performed, and their averages and standard deviations were reported in Table 1.

TABLE 1

| | Contact Angle | Friction Coefficient |
|---|---|---|
| Comparative Example 1 | 83 ± 1° | 0.41 ± 0.01 |
| Comparative Example 2 | 79 ± 2° | 0.38 ± 0.01 |
| Example I | 97 ± 1° | 0.38 ± 0.01 |
| Example II | 94 ± 1° | 0.35 ± 0.01 |

The contact angle measurements for the ACBC layers of the Example I and Example II photoconductors indicated that the incorporation of the fluorinated poly(oxetane) polymer into the ACBC layer lowered the surface energy (higher contact angle) by about 10 to about 20 percent, when compared with those of the Comparative Example 1 and Comparative Example 2 (PTFE-doped ACBC) photoconductors, and noting that incorporation of PTFE microparticles into the ACBC layer did not increase the contact angle.

Friction Coefficient Measurements

The coefficients of kinetic friction of the ACBC layers of Comparative Examples 1 and 2, Examples I and II photoconductors against a polished stainless steel surface were measured by COF Tester (Model D5095D, Dynisco Polymer Test, Morgantown, Pa.) according to ASTM D1894-63, procedure A. The tester was facilitated with a 2.5"×2.5", 200 gram weight with rubber on one side, a moving polished stainless steel sled, and a DFGS force gauge (250 grams maximum). The photoconductors were cut into 2.5"×3.5" pieces and taped onto the 200 gram weight on the rubber side with the surfaces to be tested facing the sled. The coefficient of kinetic friction was defined as the ratio of the kinetic friction force (F) between the surfaces in contact to the normal force: F/N, where F was measured by the gauge and N was the weight (200 grams). The measurements were conducted at the sled speed of 6"/minute and at ambient conditions. Three measurements were performed for each photoconductor and their averages and standard deviations were reported in Table 1.

The friction coefficient measurements for the ACBC layers of the Example I and Example II photoconductors indicated that the incorporation of the fluorinated poly(oxetane) polymer into the ACBC layer lowered the surface energy (lower friction coefficient) by about 15 percent when compared with that of the Comparative Example 1 photoconductor, and was comparable to that of Comparative Example 2 photoconductor (PTFE-doped ACBC).

While the wear or scratch resistance of the disclosed ACBC layer was not specifically measured, it is believed that the disclosed photoconductors with the ACBC layers containing the fluorinated poly(oxetane) polymer are more wear or scratch resistant than the Comparative Example 1 ACBC layer due primarily to their lower surface energies, and are comparable in wear or scratch resistance to the Comparative Example 2 photoconductor with the PTFE-doped ACBC layer.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A photoconductor comprising a first layer, a supporting substrate thereover, a photogenerating layer, and at least one charge transport layer comprised of at least one charge transport component, and wherein said first layer is in contact with said supporting substrate on the reverse side thereof, and which first layer is comprised of at least one polymer an a fluorinated poly(oxetane) polymer.

2. A photoconductor in accordance with claim 1 wherein said first layer is an anticurl backside coating layer, wherein said fluorinated poly(oxetane) polymer is a fluorinated poly (oxetane) homopolymer represented by the following structures/formulas

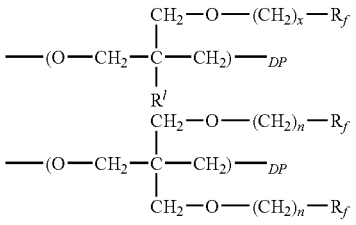

wherein $R^l$ is alkyl with from 1 to 10 carbon atoms and hydrogen; n is a number of from 1 to about 6; $R_f$ is a fluorinated aliphatic group with from 1 to about 30 carbon atoms; and DP is the degree of polymerization and is a number of from about 1 to about 100.

3. A photoconductor in accordance with claim 2 wherein said fluorinated poly(oxetane) homopolymer is polymerized from a plurality of fluorinated oxetane monomers represented by the following structures/formulas

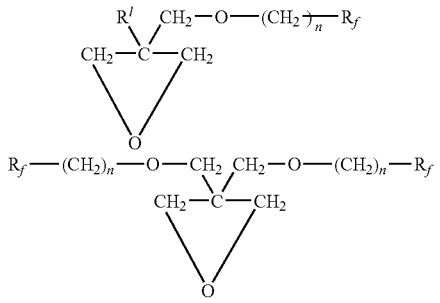

wherein $R^l$ is alkyl with from 1 to 4 carbon atoms; n is from 1 to about 4; and $R_f$ is a fluorinated aliphatic group with from 3 to about 15 carbon atoms.

4. A photoconductor in accordance with claim 2 wherein said fluorinated poly(oxetane) homopolymer is represented by the following structures/formulas

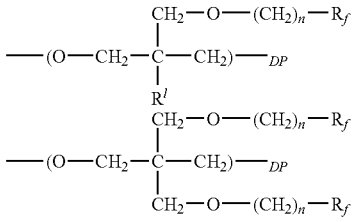

wherein $R^l$ is methyl; n is from 1 to about 2; $R_f$ is a perfluorinated linear aliphatic group with from 1 to about 10 carbon atoms; and DP is from 3 to about 50.

5. A photoconductor in accordance with claim 1 wherein said first layer is an anticurl backside coating layer and wherein said fluorinated poly(oxetane) polymer is a fluorinated poly(oxetane) copolymer of a fluorinated poly(oxetane) and an olefin polymer or copolymer, or a hydrogenated diene polymer or copolymer.

6. A photoconductor in accordance with claim 5 wherein said fluorinated poly(oxetane) copolymer is a block copolymer of a fluorinated poly(oxetane) and an olefin polymer or copolymer thereof, and said fluorinated poly(oxetane) block is represented by the following structures/formulas

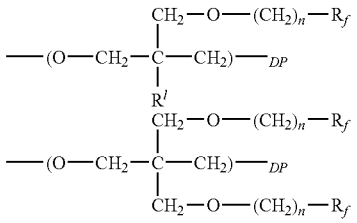

wherein $R^l$ is alkyl with from 1 to 6 carbon atoms or hydrogen; n is from 1 to about 6; $R_f$ is a fluorinated aliphatic group with from 1 to about 30 carbon atoms; and DP is from 2 to about 100; and said olefin polymer or copolymer block is derived from at least one olefin monomer having from 2 to about 8 carbon atoms and with a number average molecular weight of from about 200 to about 4,000.

7. A photoconductor in accordance with claim 6 wherein $R^l$ is methyl; n is from 1 to about 2; $R_f$ is a perfluorinated linear aliphatic group with from 1 to about 10 carbon atoms; and DP is from 3 to about 50.

8. A photoconductor in accordance with claim 5 wherein said fluorinated poly(oxetane) copolymer is a block copolymer of a fluorinated poly(oxetane) and a hydrogenated diene polymer or copolymer, and said fluorinated poly(oxetane) block is represented by the following structures/formulas

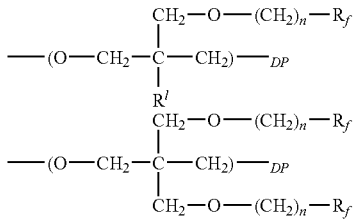

wherein $R^l$ is alkyl with from 1 to 6 carbon atoms or hydrogen; n is from 1 to about 6; $R_f$ is a fluorinated aliphatic group with from 1 to about 30 carbon atoms; and DP is from 2 to about 100; and said hydrogenated diene polymer or copolymer block is derived from at least one conjugated diene monomer with from 4 to about 10 carbon atoms and with a number average molecular weight of from about 500 to about 15,000.

9. A photoconductor in accordance with claim 8 wherein $R^l$ is methyl; n is from 1 to about 2; $R_f$ is a perfluorinated linear aliphatic group with from 1 to about 10 carbon atoms; and DP is from 3 to about 50 of said fluorinated poly(oxetane) block, and said hydrogenated diene polymer or copolymer block possesses a number average molecular weight of from about 1,000 to 8,000.

10. A photoconductor in accordance with claim 1 wherein said first layer is an anticurl backside coating layer, and wherein said fluorinated poly(oxetane) polymer is selected from a group consisting of the following structures/formulas

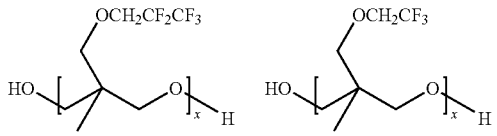

wherein x is about 6, or about 20;

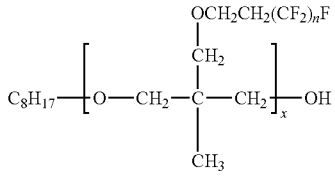

-continued

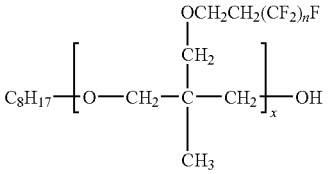

wherein x is about 4.5, and n is about 8; wherein x is about 18, and n is about 8;

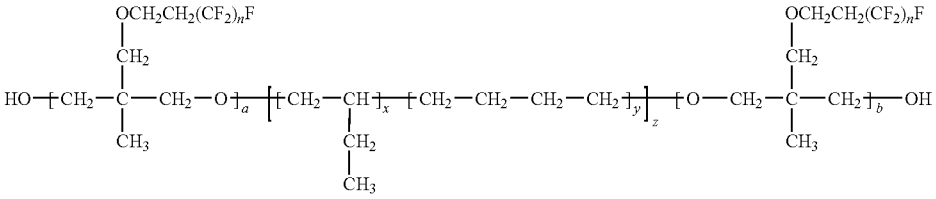

wherein x is about 2; y is about 8; z is about 160; a+b is about 6, and n is about 8; and wherein said first layer and said supporting substrate are each comprised of a single layer.

11. A photoconductor in accordance with claim 1 wherein said charge transport component is comprised of at least one of aryl amine molecule

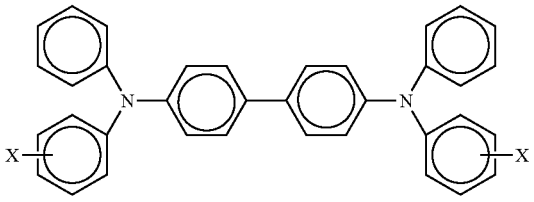

and

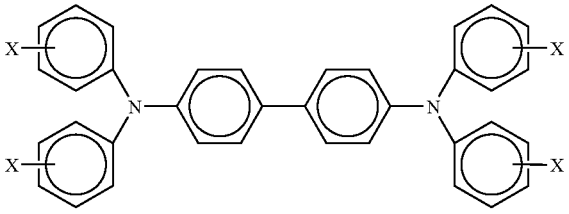

wherein X is selected from the group consisting of at least one of alkyl, alkoxy, aryl, and halogen.

12. A photoconductor in accordance with claim 11 wherein said alkyl and said alkoxy each contains from about 1 to about 12 carbon atoms, and said aryl contains from about 6 to about 36 carbon atoms.

13. A photoconductor in accordance with claim 11 wherein said aryl amine is N,N'-diphenyl-N,N-bis(3-methylphenyl)-1,1'-biphenyl-4,4'-diamine.

14. A photoconductor in accordance with claim 1 wherein said charge transport component is comprised of

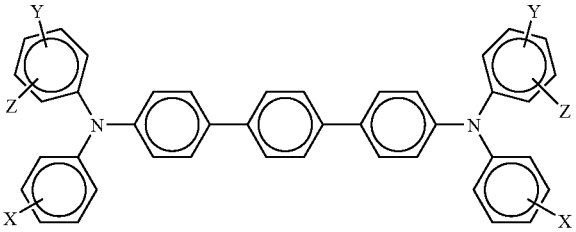

wherein X, Y and Z are independently selected from the group consisting of at least one of alkyl, alkoxy, aryl, and halogen.

15. A photoconductor in accordance with claim 14 wherein alkyl and alkoxy each contains from about 1 to about 12 carbon atoms, and aryl contains from about 6 to about 36 carbon atoms.

16. A photoconductor in accordance with claim 1 wherein said charge transport component is an aryl amine selected from the group consisting of N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, N,N'-diphenyl-N,N'-bis(3-chlorophenyl)-[p-terphenyl]-4,4"-diamine, and optionally mixtures thereof.

17. A photoconductor in accordance with claim 1 wherein said charge transport component is comprised of aryl amine mixtures.

18. A photoconductor in accordance with claim 1 wherein said member further includes in at least one of said charge transport layers an antioxidant comprised of a hindered phenolic and a hindered amine.

19. A photoconductor in accordance with claim 1 wherein said photogenerating layer is comprised of a photogenerating pigment or photogenerating pigments.

20. A photoconductor in accordance with claim 19 wherein said photogenerating pigment is comprised of at least one of a metal phthalocyanine, a metal free phthalocyanine, a perylene, and mixtures thereof.

21. A photoconductor in accordance with claim 1 further including a hole blocking layer, and an adhesive layer, and wherein said substrate is comprised of a conductive material.

22. A photoconductor in accordance with claim 1 wherein said substrate is a flexible web.

23. A photoconductor in accordance with claim 1 wherein said at least one charge transport layer is from 1 to about 7 layers.

24. A photoconductor in accordance with claim 1 wherein said at least one charge transport layer is from 1 to about 2 layers.

25. A photoconductor in accordance with claim 1 wherein said at least one charge transport layer is comprised of a top charge transport layer and a bottom charge transport layer, and wherein said top layer is in contact with said bottom layer and said bottom layer is in contact with said photogenerating layer.

26. A photoconductor comprised in sequence of a supporting substrate, a photogenerating layer thereover, and a charge transport layer, and wherein said substrate includes on the reverse side thereof a layer comprised of an additive and a polymer, and wherein the additive is comprised of at least one of the following structures/formulas

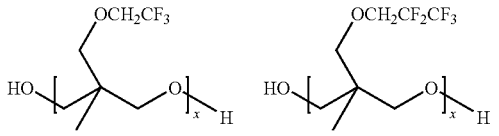

wherein x represents the number of repeating units or segments of from about 3 to about 30.

27. A photoconductor in accordance with claim 26 wherein said additive is present in an amount of from about 0.05 to about 20 weight percent.

28. A photoconductor in accordance with claim 26 wherein said additive is present in an amount of from about 1 to about 10 weight percent, and said first layer is located opposite the supporting substrate surface not in contact with the photogenerating layer.

29. A photoconductor in accordance with claim 26 wherein said reverse side layer has a thickness of from about 10 to about 50 microns, and wherein said additive is present in an amount of from about 1 to about 5 weight percent, and wherein said first layer is located opposite the supporting substrate surface free of contact with the photogenerating layer.

30. A photoconductor comprised in sequence of a supporting substrate, a photogenerating layer thereover, and a charge transport layer, and wherein said substrate includes on the reverse side thereof an anticurl backside coating layer comprised of a suitable polymer, and dispersed therein a fluorinated poly(oxetane) polymer additive of at least one of the following formulas/structures

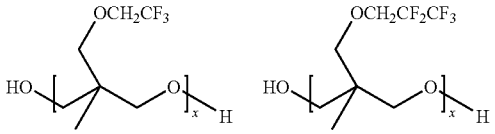

wherein x represents a number of from about 3 to about 50, and which additive is present in an amount of from about 0.5 to about 30 weight percent.

31. A photoconductor in accordance with claim 1 wherein the fluorinated poly(oxetane) polymer additive is present in an amount of from about 0.1 to about 20 weight percent; and which layer further includes a polymer present in an amount of from about 80 to about 99.9 weight percent.

32. A photoconductor in accordance with claim 1 wherein said additive is of the following formula/structure

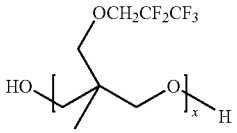

and present in an amount of from about 1 to about 5 weight percent, and wherein x is from about 3 to about 30.

* * * * *